US006273759B1

(12) United States Patent
Perino et al.

(10) Patent No.: US 6,273,759 B1
(45) Date of Patent: Aug. 14, 2001

(54) MULTI-SLOT CONNECTOR WITH INTEGRATED BUS PROVIDING CONTACT BETWEEN ADJACENT MODULES

(75) Inventors: Donald V. Perino, Los Altos; Nader Gamini, San Jose, both of CA (US)

(73) Assignee: Rambus INC, Los Altos, CA (US)

( * ) Notice: Subject to any disclaimer, the term of this patent is extended or adjusted under 35 U.S.C. 154(b) by 0 days.

(21) Appl. No.: 09/551,855

(22) Filed: Apr. 18, 2000

(51) Int. Cl.[7] ..... H01R 24/00
(52) U.S. Cl. ..... 439/631
(58) Field of Search ..... 439/631, 76.1, 439/61, 59; 710/126; 361/788

(56) References Cited

U.S. PATENT DOCUMENTS

| | | | | |
|---|---|---|---|---|
| 2,904,768 | * | 9/1959 | Rasmussen | 439/631 |
| 4,998,886 | * | 3/1991 | Werner | 439/66 |
| 5,104,324 | | 4/1992 | Grabbe et al. . | |
| 5,186,632 | * | 2/1993 | Horton et al. | 439/67 |
| 5,334,962 | | 8/1994 | Higgins et al. . | |
| 5,536,177 | | 7/1996 | Casey . | |
| 5,664,968 | | 9/1997 | Mickievicz . | |
| 5,812,797 | | 9/1998 | Crane, Jr. et al. . | |
| 5,827,084 | | 10/1998 | Biernath . | |
| 5,908,333 | | 6/1999 | Perino et al. . | |
| 5,928,036 | * | 7/1999 | Thrush | 439/631 |
| 6,086,427 | * | 7/2000 | Cahaly | 439/631 |

FOREIGN PATENT DOCUMENTS 0 436 943 A1 7/1990 (EP) .

* cited by examiner

*Primary Examiner*—Brian Sircus
*Assistant Examiner*—Brian S. Webb

(57) ABSTRACT

The present invention provides an electrical connector having an integrated bus to provide a signal path having a properly matched impedance. The electrical connector includes a housing formed with a number of slots adapted to receive a module. Electrical contacts are placed between adjacent slots in the electrical connector, such that the combination of electrical contacts and inserted modules forms the integrated bus. Since inter-slot connections are not made through the motherboard, the noted impedance discontinuities do not arise. The electrical contacts generally include electrical signal contacts and ground contacts generally formed within the housing of the electrical connector but include metal contacts which extend into adjacent slots to form a portion of the integrated bus. The plurality of modules thus connected may include a termination module, and/or a dummy module. The bus may be terminated in a termination resistor found on the motherboard, the electrical connector, or a termination module inserted into the electrical connector. Alternatively, one or more of the modules may incorporate an integrated circuit having an electronically actuated termination resistor.

15 Claims, 13 Drawing Sheets

MULTI-SLOT CONNECTOR WITH INTEGRATED BUS PROVIDING CONTACT BETWEEN ADJACENT MODULES

BACKGROUND OF THE INVENTION

The present invention relates to a bus system using a multi-slot connector. More particularly, the present invention relates to a multi-slot connector having an integrated bus which connects a plurality of modules in a bus system.

Contemporary bus systems provide for the daisy chain connection of multiple modules on a motherboard. A conventional topology for connecting multiple modules is conceptually illustrated in FIG. 1A. In this example, one or more connectors 11 are mounted on a motherboard 10. Each connector 11 is adapted to hold a module 13. Within this arrangement, modules 13 are sometimes termed "daughterboards" since each commonly holds one or more integrated circuits 14.

In many contemporary bus systems, a bus runs between a controller 12 and a bus termination impedance 15. The bus typically comprises multiple signal lines communicating data and/or control information between the controller and one or more of the integrated circuits on one or more of modules 13. Controller 12 may take many forms including a microprocessor or a memory controller. The bus may range in size from a single signal line to a collection of complex signal line structures. The one or more integrated circuit(s) 14 on each module may be memory device(s) or logic device(s).

The increasing demand for data bandwidth from contemporary bus systems drives the development of impedance controlled buses within such systems. That is, increasing bus system clock speeds require carefully controlled signal line impedances in order to effectively communicate data and control information. At contemporary clock speeds, which already range above several hundred MHz, impedance mismatches on the bus will create unwanted signal reflections which act as noise signals on the bus. Recognizing the need to balance signal line impedances, conventional bus systems terminate the bus in a characteristic impedance 15.

Data and control signals traversing the bus from controller 12 to termination impedance 15 travel the signal path 16 shown in FIG. 1A. Of note, some portions of the signal path pass through the several connectors 11 and other portions of the path pass through the motherboard 10. The transmission performance of such a "mixed" signal path has generally been acceptable in bus systems running a relatively lower frequencies. However, the transmission performance of this type of signal path has proved increasingly inadequate as bus system operating at higher frequencies.

In theory, the composition of the motherboard and the connectors mounted on the motherboard, as well as the signal line traces forming the bus, should produce a consistent impedance matched to termination impedance 15. Actual practice is, however, far from theory. The motherboard is often manufactured by a different entity than the one manufacturing connectors 11 or modules 13. In fact, the printed circuit boards (PCBs) commonly used as motherboards are notoriously variable in their final composition and implementation, and therefore their effective impedance. Further, motherboard impedances tend to vary from unit to unit depending on actual finished trace width, dielectric thickness and composition. As a result, signal path 16 shown in FIG. 1A often suffers from multiple impedance discontinuities caused by the signal path transitions from motherboard-to-connector, and from connector-to-motherboard.

SUMMARY OF THE INVENTION

The present invention provides an electrical connector having an integrated bus. Such a connector provides a signal path having a properly matched impedance. Unwanted signal reflections resulting from the impedance discontinuities inherent in the conventional bus system are significantly reduced with corresponding reductions in bus noise.

In one aspect, the electrical connector of the present invention includes a housing formed with a number of slots. Each slot is adapted to receive a module. Electrical contacts are placed between adjacent slots in the electrical connector, such that the combination of electrical contacts and inserted modules forms the integrated bus. Since inter-slot connections are not made through the motherboard, the noted impedance discontinuities do not arise.

The electrical contacts generally include electrical signal contacts and ground contacts. In one aspect, the electrical contacts are substantially formed within the housing of the electrical connector but include metal contacts which extend into adjacent slots to form a portion of the integrated bus.

In another aspect, the present invention provides a bus system including a motherboard having a high speed bus and an electrical connector with an integrated bus connected to the high speed bus. The electrical connector includes multiple slots, each adapted to receive a module and thereby connect the module to the high speed bus via the integrated bus. The plurality of modules thus connected may include a termination module, and/or a dummy module.

The bus may be terminated in a termination resistor found on the motherboard, the electrical connector, or a termination module inserted into the electrical connector. Alternatively, one or more of the modules may incorporate an integrated circuit having an electronically actuated termination resistor.

DETAILED DESCRIPTION

At the threshold of this description, the nature and advantages of the present invention are contrasted with several conventional connector designs and conventional connection schemes. Consider the edge view of modules A and B shown in FIG. 1B. These modules are characterized by finger connectors on either side of the module. While these finger connectors typically include multiple contacts, the present illustration need only show one finger connector contact, or "pin," per each side of modules A and B. Similarly, only one or two signal lines forming bus 16 are illustrated for the sake of clarity.

Figure 1A:
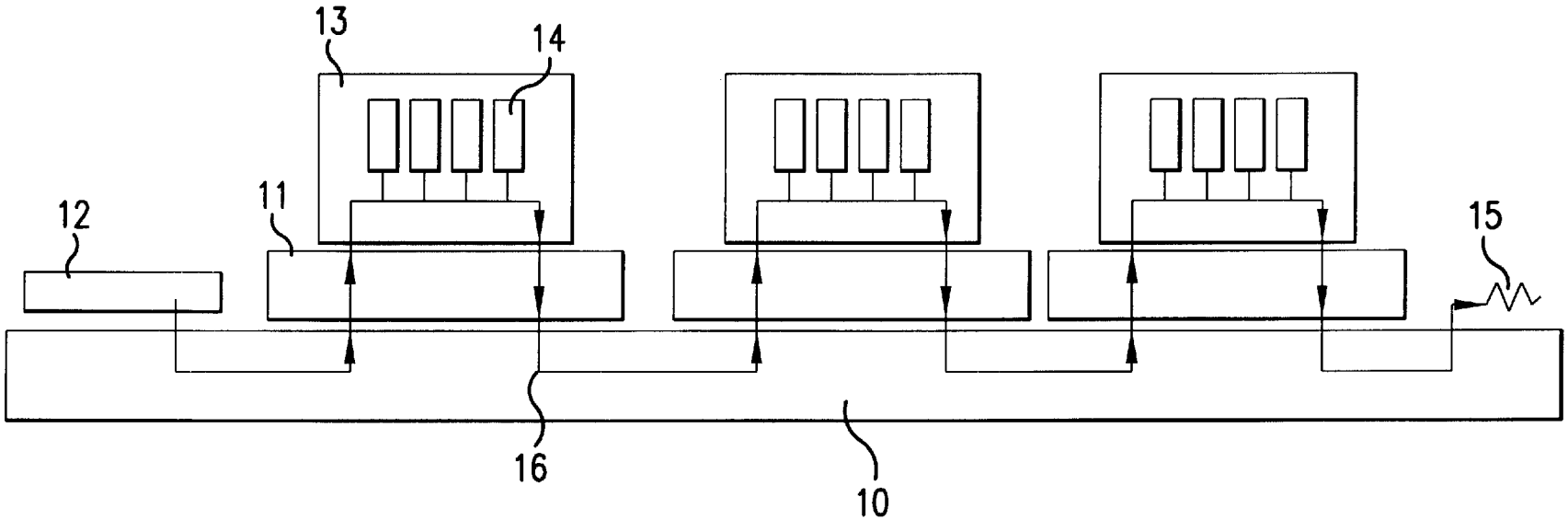
FIG. 1A PRIOR ART
FIG. 1A conceptually illustrated a conventional bus system connecting a number of modules.
Figure 1B:
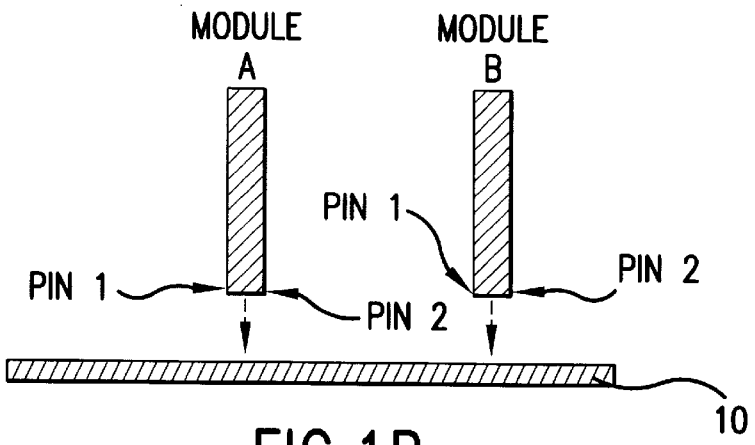
FIG.1B PRIOR ART
FIGS. 1B through 1D illustrate some conventional bus-to-module connection schemes.
Figure 1C:
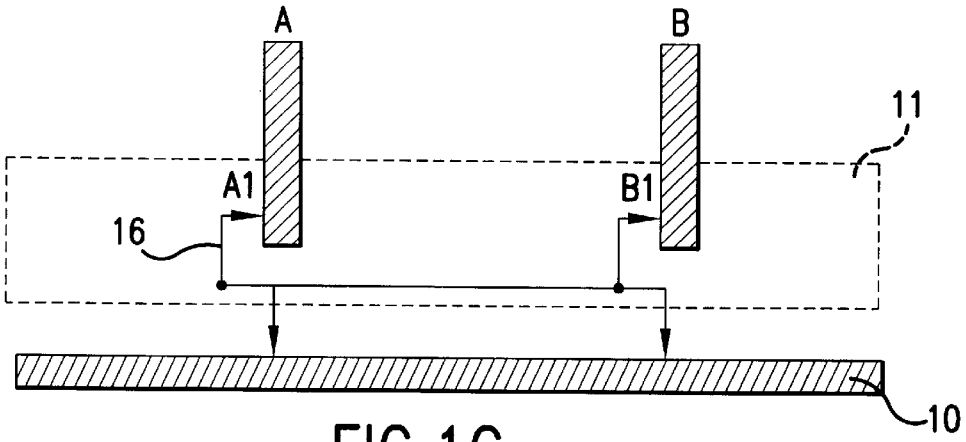
FIG.1C PRIOR ART

A first conventional connection scheme, as taught by U. S. Pat. No. 5,104,324, is shown in FIG. 1C. Within this scheme, bus 16 is integrated into connector 11 which connects modules A and B to motherboard 10. Bus 16 runs at least partially through connector 11 outside of modules A and B. Pin A1 on module A and pin B1 on module B are connected to bus 16 down through the body of connector 11. Bus 16 is also connected to motherboard 10 as shown.

Figure 1D:
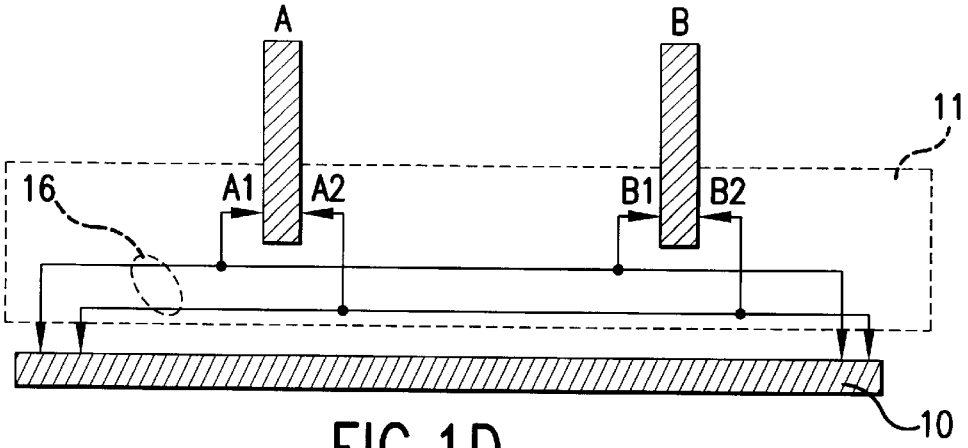
FIG.1D PRIOR ART

A second conventional connection scheme, taught by U.S. Pat. No. 5,908,333, is shown in FIG. 1D. Within this scheme, a first signal line in bus 16 connects A1 and B1 and a second signal line connects A2 and B2.

Figure 2A:
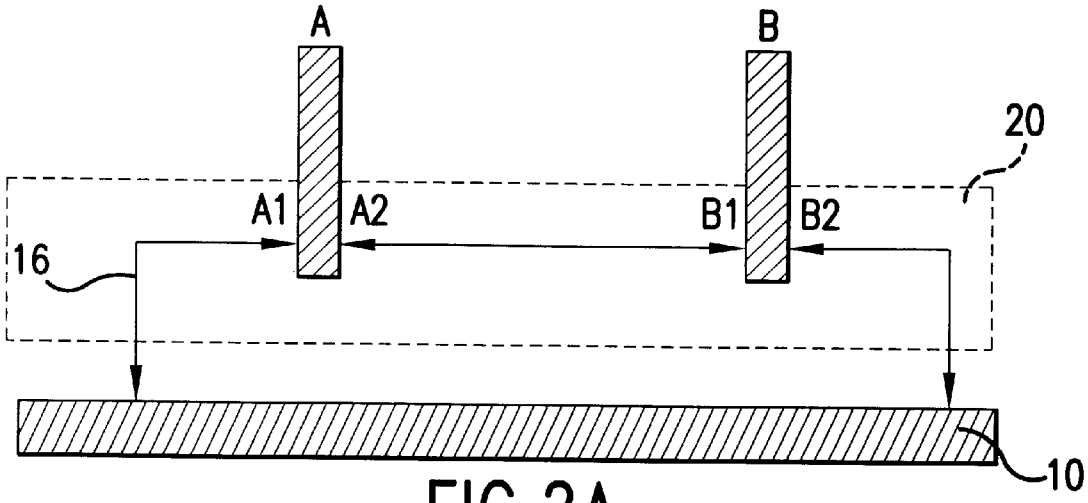
FIG. 2A conceptually illustrates a bus-to-module connection scheme consistent with the present invention.

In contrast to the these conventional connection schemes, a connection scheme according to the present invention is shown in FIG. 2A. Within this connection scheme, signal path 16 moves from motherboard 10 through connector 20 to pin A1, from pin A1 to pin A2, from pin A2 to pin B1, from pin B1 to pin B2, and from pin B2 back to motherboard 10. In so doing, the signal path traverses the body of modules A and B. For example, the module shown in FIG. 4 may be used to implement this "module-integral" portion of the signal path.

FIG. 2A conceptually illustrates the mechanical aspects of the bus-to-module connection scheme according to the present invention. The electrical aspects of the present invention are further illustrated in FIG. 2B. As can be seen, the signal path between the modules resides within the electrical connector. No signal path transitions between the connector and the motherboard are required, at least between the modules. The impedance discontinuities associated with such transitions are avoided.

Figure 2B:
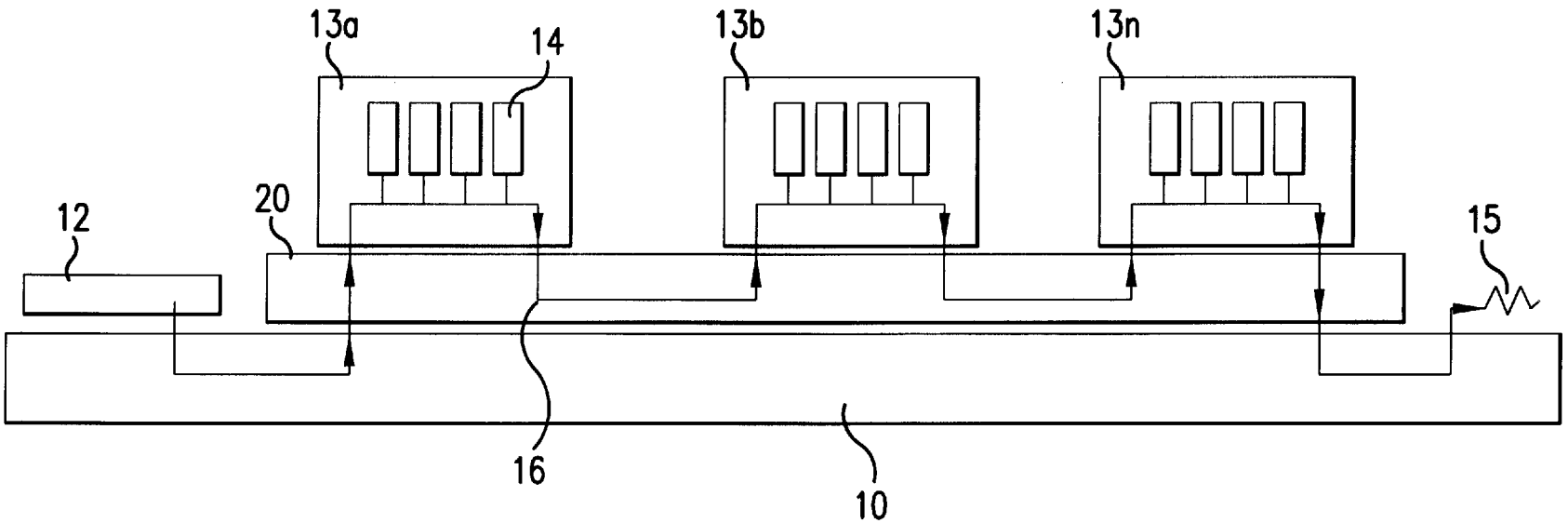
FIG. 2B conceptually illustrates a bus system according to the present invention which connects a number of modules using an electrical connector having an integrated bus.

The elements shown in FIG. 2B are largely the same as those described with reference to FIG. 1A. Here, however, electrical connector 20, together with the inserted modules, form at least the portion of signal path 16 between a first module 13*a* and a last module 13*n*. The present invention contemplates any reasonable number of modules connected between controller 12 and termination impedance 15, and the electrical connector described may include a corresponding number of slots. By providing the primary portion of signal path 16 within electrical connector 20, the impedance mismatches resulting from repeated signal path transitions between motherboard 10 and connectors 20 are eliminated. Such provision of the signal path by electrical connector 20 allows a bus system to be implemented using motherboards from multiple manufacturers with reduced concerns over the variability of the motherboard performance characteristics. In other words, one or more high quality connectors providing an integrated bus signal path between a plurality of modules can overcome the problems associated with the prior art.

Further, unlike the conventional connection schemes illustrated in FIGS. 1C and 1D, the present invention forms bus 16, at least in part, from modules 13 and from the connections between the bus and each one of the modules 13. In effect, bus 16 connects A2 to B1, B2 to C1, etc., down the length of connector 20.

The electrical connectors (signal and ground) may be implemented in many forms. U.S. Pat. No. 5,908,333 describes several important design considerations for a connector having an integrated bus. These considerations may be extended to the present invention and the disclosure of this document are incorporated herein by reference. In particular, the ground connector structure and connection scheme disclosed in this document are readily adaptable to the present invention.

Figure 3B:
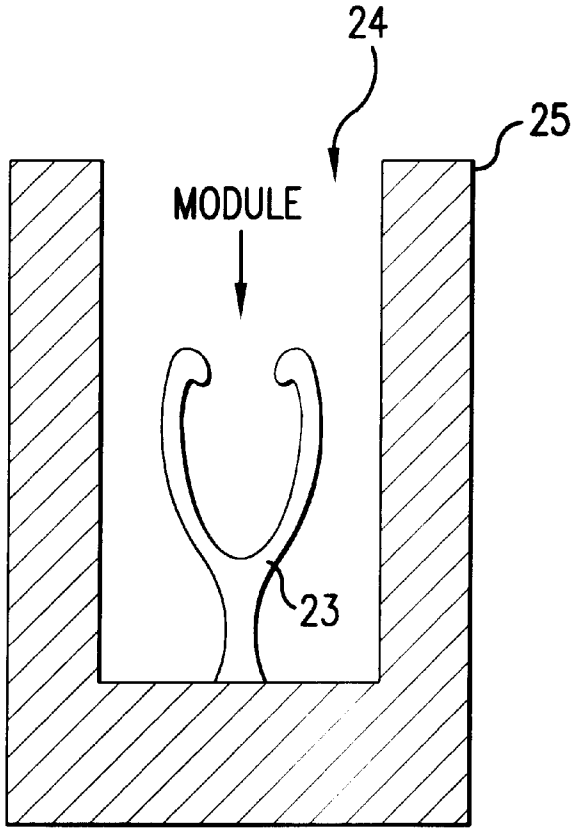
FIG.3B PRIOR ART
FIGS. 3A and 3B illustrate conventional contact strictures.
Figure 3A:
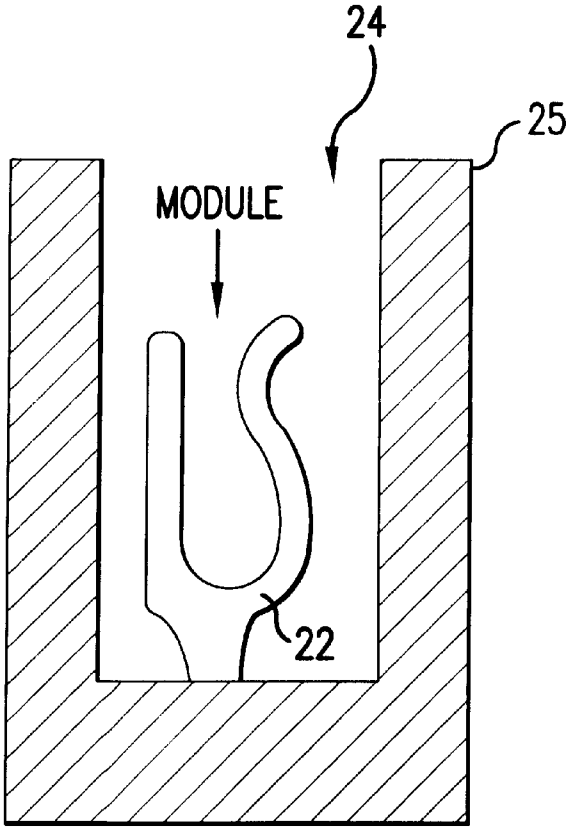
FIG.3A PRIOR ART

However, these design considerations are applied in the present invention by means of a novel electrical contact structure. FIGS. 3A and 3B illustrate conventional electrical contact structures. Of note, such conventional electrical contacts are generally placed within a slot 24 formed in the connector housing 25. The electrical contact structure 22 shown in FIG. 3A is similar to the electrical contact structures taught in U.S. Pat. No. 5,908,333 and 5,104,324. The electrical contact structure 23 shown FIG. 3B is similar to the electrical contact structure taught in European Patent Application 0 436 943. Both of these exemplary electrical contact structures "capture" an inserted module between two opposing ends of a single contact structure. That is, the conventional electrical contact structures are characterized by a unitary spring-like body having two opposing branches which contact opposite sides of an inserted module. The mechanical pressure provided by each branch of the contact structure on a corresponding side of the inserted module holds the module in place and provides at least one electrical connection point between the module and the electrical contact.

Figure 3C:
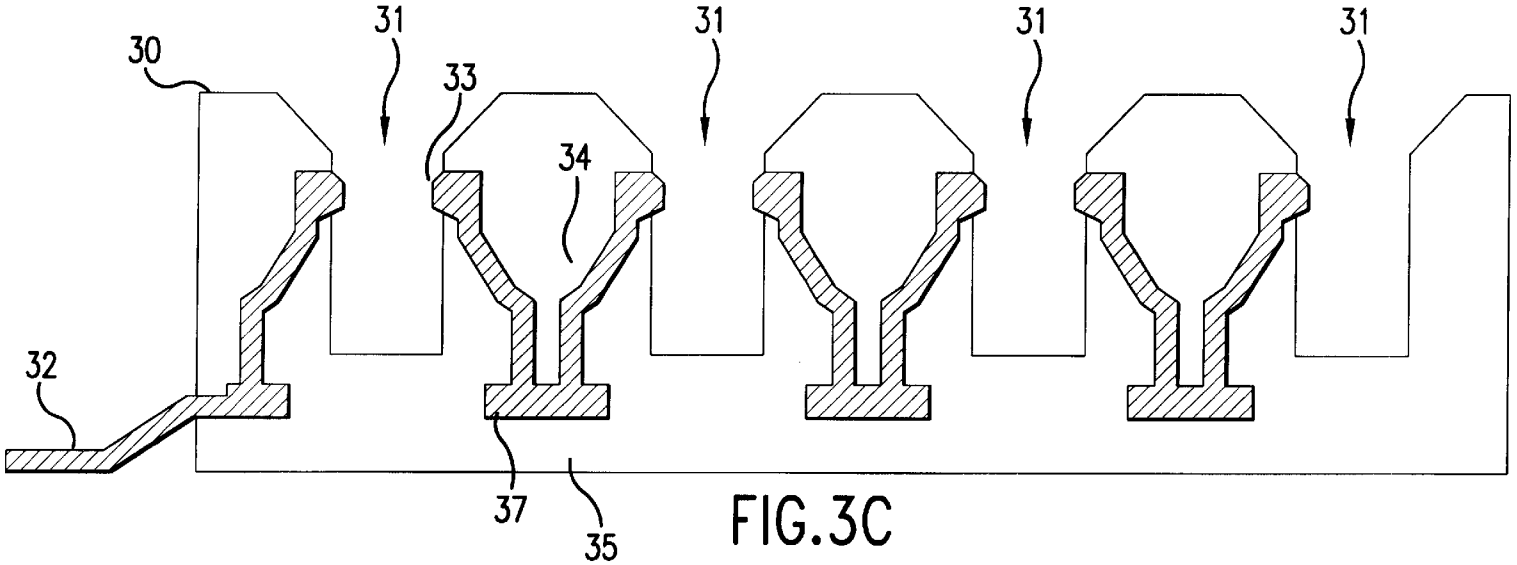
FIG. 3C illustrates one embodiment of an electrical connector formed in accordance with the present invention.
Figure 3D:
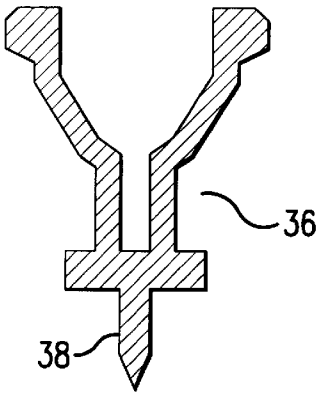
FIG. 3D illustrates an electrical ground contact useful in the electrical connector of FIG. 3C.

In contrast, a novel electrical contact structure adapted for use within the present invention is shown in FIGS. 3C and 3D. This electrical contact structure, unlike the conventional ones, is substantially formed within the body of connector 30—not within a slot in the connector. Further, a module inserted into a slot is mechanically captured (and electrically connected) between two different electrical contact structures, rather than two branches of a single contact structure. At first appearance, such a relationship appears counterintuitive to a mechanical designer, since the pressure of an inserted module will impose stresses upon the connector housing. However, the connector housing may be designed to withstand such stresses in order to realize the advantages associated with the novel bus structure of the present invention.

In one presently preferred embodiment shown in FIG. 3C, the electrical contact (35 or 36) according to the present invention comprises at least a contact surface 33 extending into slot 31, a contact arm 34 applying a mechanical spring force on contact surface 33 so as to forced it into slot 31, and base member 37 anchoring contact arm 34. Base member 37 and contact arm 34 are formed substantially within the body of connector 30, whereas contact surface 33 is exposed through one of the lateral walls forming slot 31. Of note, each contact surface 33 is opposed by a facing contact surface from another electrical contact. When a module is inserted into slot 31, these opposing contact surfaces mechanically hold the module in place, while each contact surface 33 forms an electrical connection point on a corresponding side of the inserted module.

As shown in FIG. 3C, the electrical connector according to the present invention is characterized by an array of electrical contacts (35 and 36) formed within a plastic (or similar non-conductive material) body 30. The shape and length of housing 30 defines a number of slots 31 which are each adapted to receive a module. The openings within the opposing lateral walls of each slot 31 expose an array of contact surfaces 33. Each contact surface 33 in this array is an exposed end of an electrical contact (35, 36) formed within housing 30.

The cross-sectional view of the electrical connector shown in FIG. 3C only shows a first row of electrical contact 35. However, a number of electrical contacts can be envisioned "behind" this row. Electrical contact 35 is a signal contact, i.e., it carries a bus signal received in connector 30, for example, via a signal line 32 from the motherboard, when a module is inserted into an associated slot. Electrical contact 35 may be formed by two of the foregoing electrical contacts being formed back-to-back with base members 37 being electrically connected (soldered or welded) within the body of the connector 30. Alternatively, a single base member 37 may be connected to two contact arms. However implemented, electrical contact 35 forms a portion of the integrated bus of the electrical connector between the two adjacent slots.

The metal contact surface 33 of each electrical contact is designed to snugly press against a corresponding "edge finger" on a module, as described in greater detail below. Contact arm 34 is designed to deform when a module is inserted into the slot and thereby provide a force tending to maintain the electrical connection between the electrical contact of the connector and a corresponding edge finger of the module.

While electrical signal contact 35 forms part of a signal path passing through the electrical connector, the electrical ground contact 36 shown in FIG. 3D forms part of a ground line (or ground plane) separating signal lines. Ground contact 36 may comprise ground spike 38 which penetrates the body of connector 30 to reach a ground contact or ground plane, as described below.

Figure 3E:
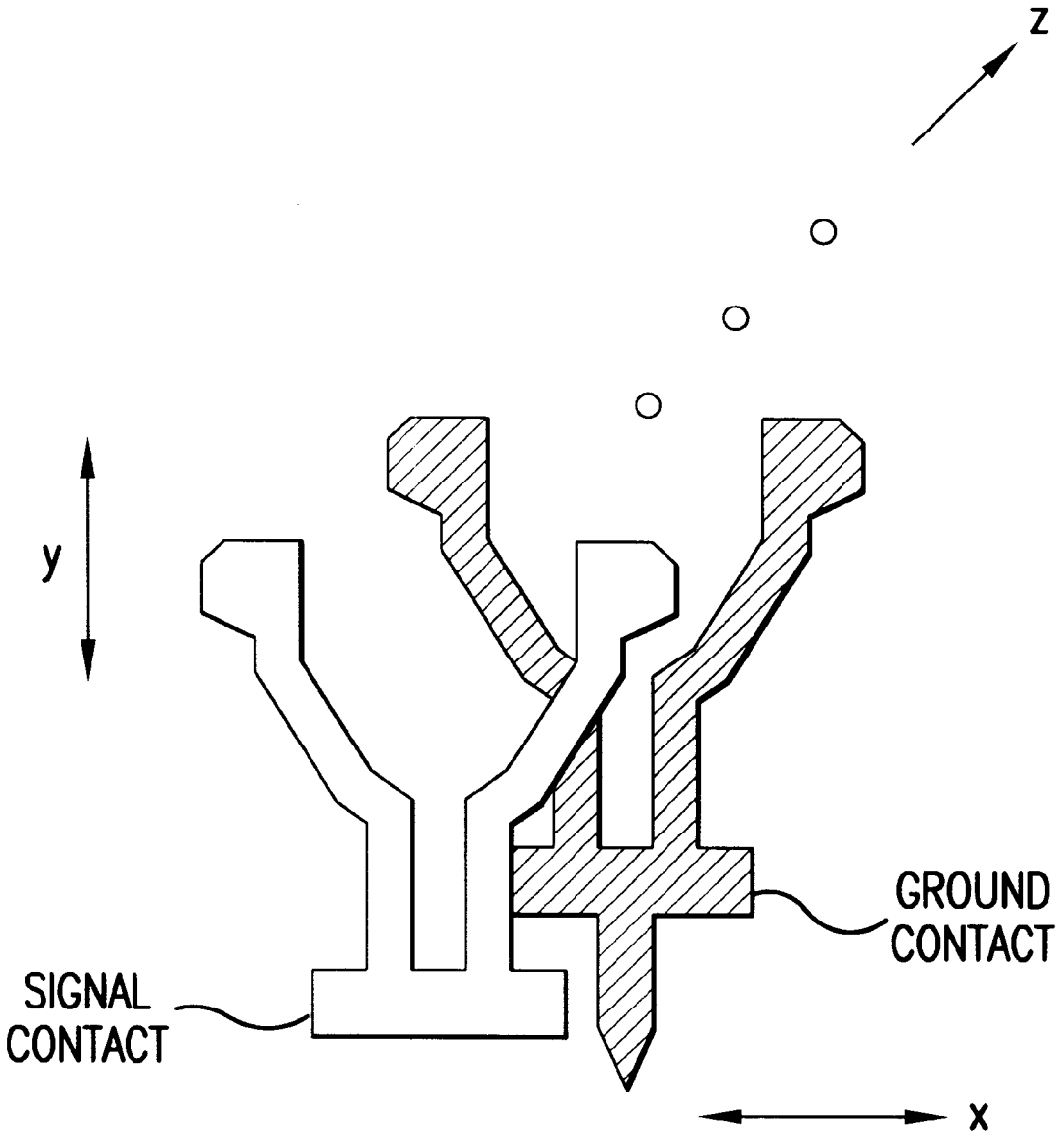
FIG. 3E illustrates the stacked planar relationship which may exists between signal and ground contacts in the electrical connector of the present invention.

As is well understood in the art, the placement of high speed signal lines in close proximity to one another will result in significant cross coupling of signals and other noise phenomenon. Accordingly, ground lines are provided at intervals between signal lines to reduce these noise sources. The present invention recognizes this necessary design consideration and thus the electrical contacts formed in the connector may be either signal contacts or ground contacts, as needed by the electrical connector designer. FIG. 3E shows how signal contacts and ground contacts may be alternately "stacked" in the Z direction relative to the electrical connector cross-section shown in FIG. 3C.

The design of the individual modules must cooperate with the design of the electrical connector to yield an effective connection scheme. One preferred module structure is shown in FIG. 4.

Figure 4:
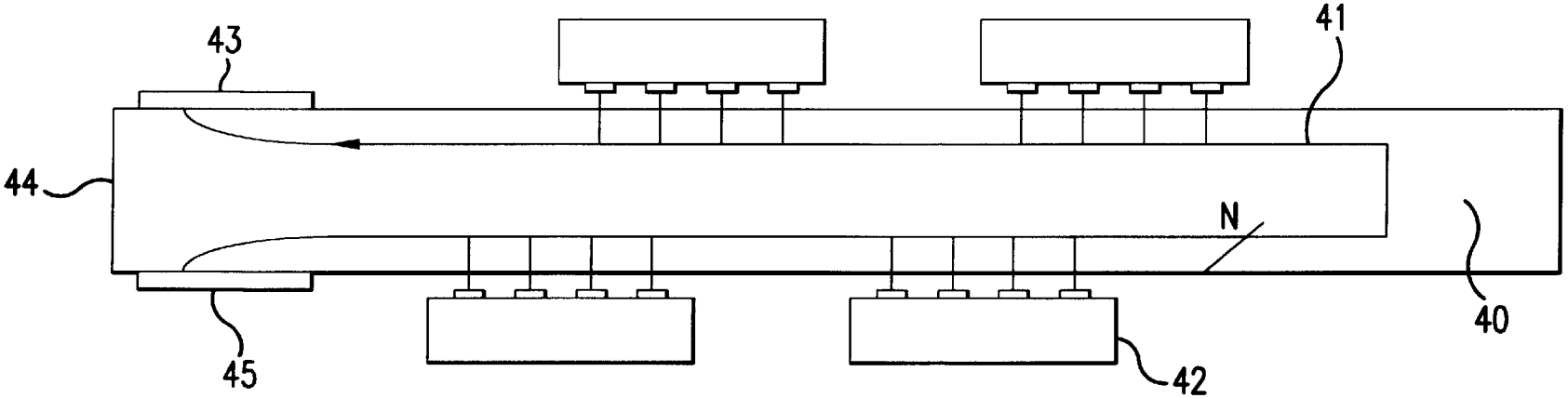
FIG. 4 illustrates an exemplary module useful within the bus system according to the present invention.

In FIG. 4, a module-integrated bus portion 41 (N signal lines in width) traverses the module 40. The signal lines of this bus portion 41 may be formed on the surface(s) of the PCB forming module 40. However, as presently preferred, module-integrated bus portion 41 is formed internal to module 40. Such internal placement of bus portion 41 provides additional electrical signal isolation and physical protection for the metal traces forming the bus portion. The term "bus portion" is used above in the context of individual modules, because this structure actually forms a portion of the larger bus signal path 16 (illustrated in FIG. 2B) connecting the modules via the connector to the motherboard.

In one preferred embodiment, module 40 comprises a laterally disposed PCB. That is, longer primary surfaces (top and bottom) are defined in relation to much narrower side surfaces. This thin, laterally extended structure allows for the effective population of one or both primary surfaces, while also forming one or two end portions of the module adapted for insertion into an electrical connector slot.

The exemplary module shown in FIG. 4 comprises an end portion 44 having a first set of edge fingers 43 and a second set of edge fingers 45 respectively formed on opposite primary surfaces of module 40. When pressed into slot 31 of the electrical connector shown in FIG. 3C, the first set of edge fingers 43 come into electrical contact with the metal contact surfaces extending through one lateral wall of slot 31. The second set of edge fingers 45 are similarly placed in electrical contact with the metal contact surfaces extending through the opposing lateral wall of slot 31. Once connected in this manner, a bus signal passes from one electrical contact through its contact surface to one of the first or second set of edge fingers, then traverses the module-integrated bus portion, and finally exits the module through the opposing set of first or second set of edge fingers into the contact surface of the other electrical connector.

The exemplary module shown in FIG. 4 comprises integrated circuits (ICs) 42 connected to bus portion 41 on both primary surfaces of module 40. Alternatively, only one primary surface may be populated with ICs. Each IC is connected to bus portion 41 through vias formed in the corresponding primary surface of module 40. If bus portion 41 were formed on the surface(s) of module 40, various surface mount techniques might be used to connect the ICs.

Figure 5:
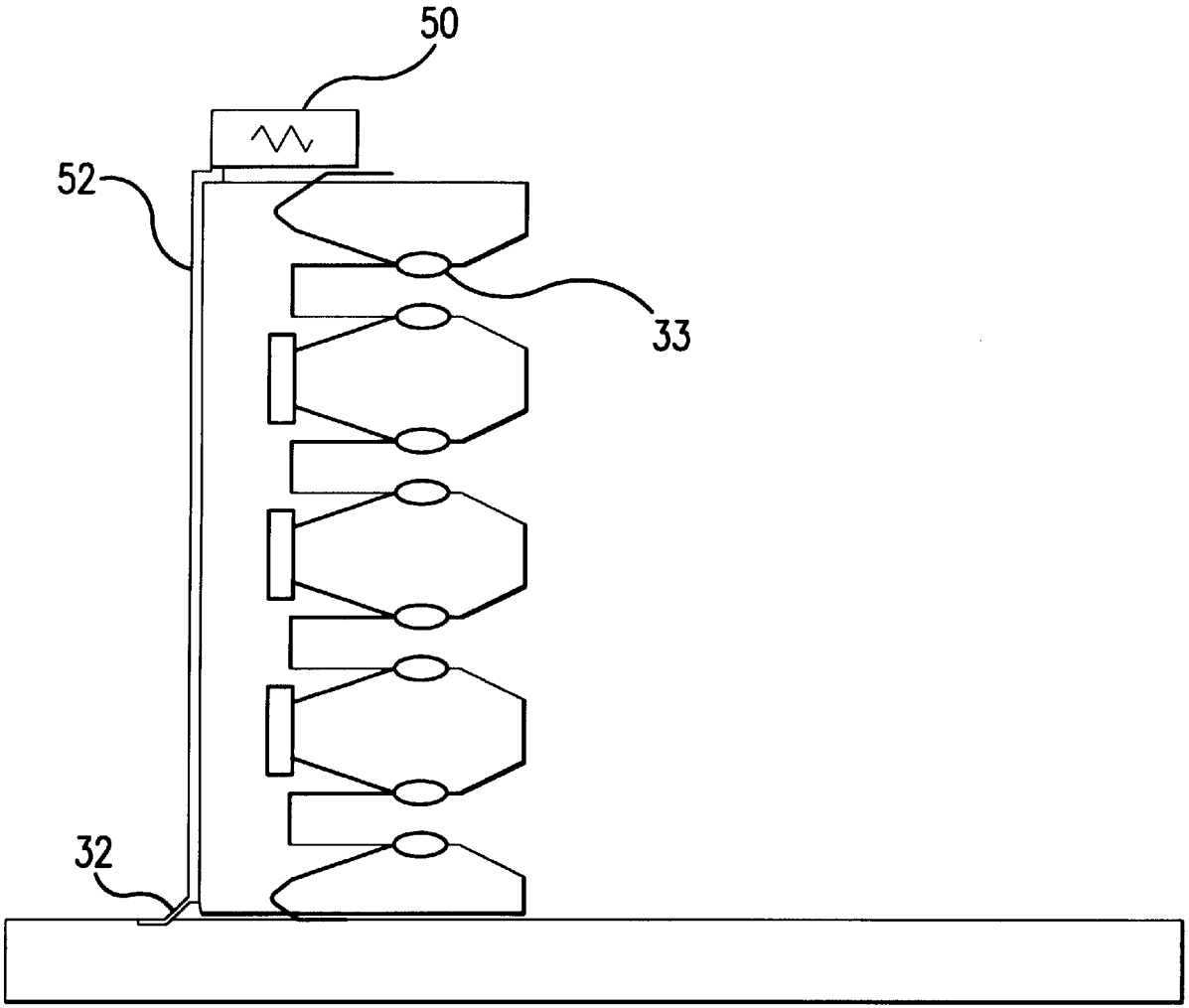
FIG. 5 illustrates another embodiment of an electrical connector formed in accordance with the present invention.

A "horizontal" embodiment of the electrical connector was described with respect to FIG. 3C. The electrical connector shown in FIG. 5 is very similar to the connector shown in FIG. 3C, except for its "vertical" orientation. The terms horizontal and vertical are best understood in relation to the primary plane of the motherboard upon which the electrical connector is mounted. but they are clearly relative designations.

The exemplary vertical connector shown in FIG. 5 incorporates two additional elements: a ground plane 52 and a termination resistor 50. The electrical ground contacts described in relation to FIG. 3D may be coupled to a ground plane 52 which is formed integral to the electrical connector. The position and connection mechanism for termination resistor 50 is a matter of careful design consideration. In the exemplary vertical connector shown in FIG. 5, termination resistor 50 is conveniently located on the electrical connector between the last slot of the connector and ground plane 52, since the conductor forming ground plane 52 may be formed to be as wide as the connector body. This connection provides termination resistor 50 with a low impedance path to ground. Further, all of the available slots in the electrical connector may be used to connect modules. (Compare the embodiments shown in FIGS. 6 and 7 where one slot is used to connect a termination module).

Figure 6:
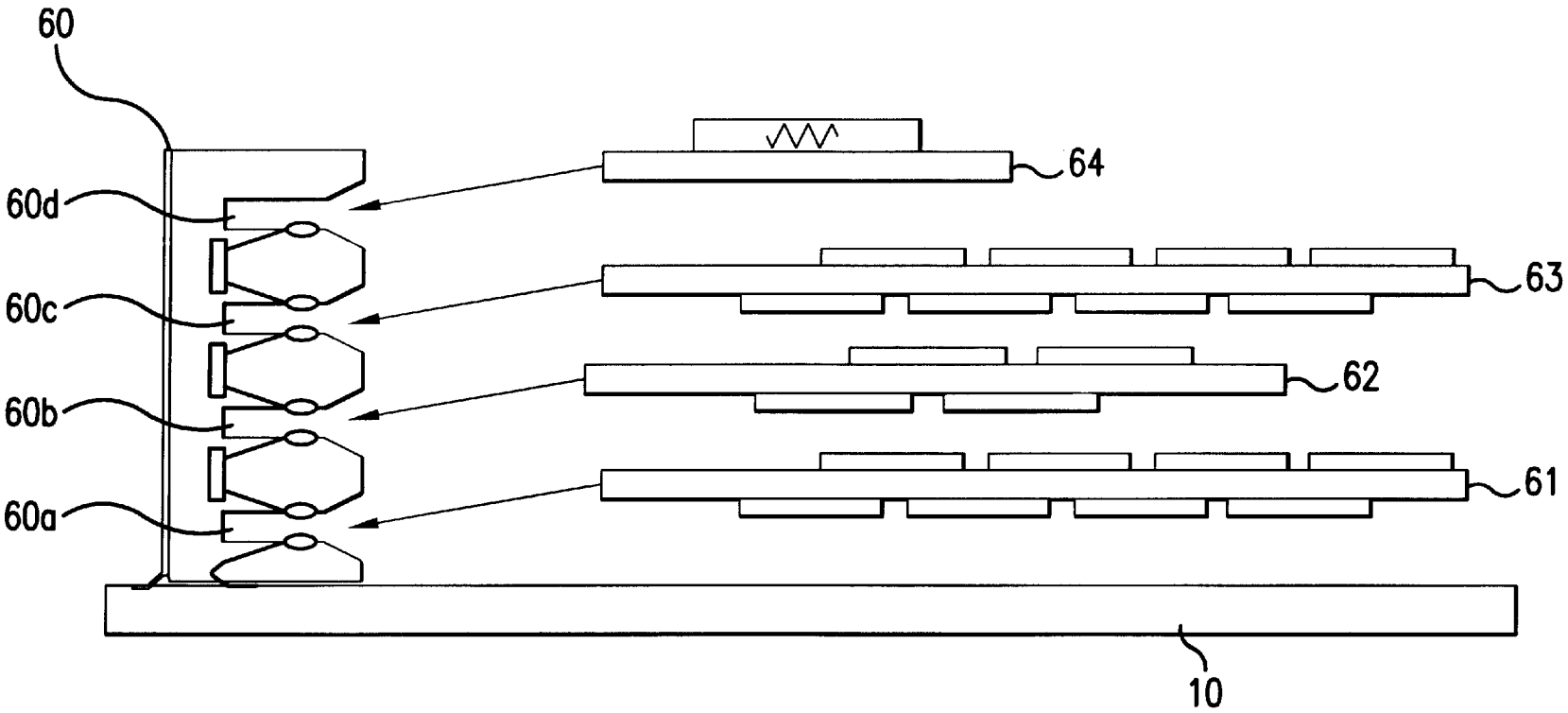
FIG. 6 illustrates an exemplary bus system configured in accordance with the present invention.

While the integrated termination resistor has been illustrated with respect to the vertical connector shown in FIG. 6, it may also be incorporated into a horizontal connector. By integrating a termination resistor into the multi-slot electrical connector design. A number of design issues may be addressed. For example, one of ordinary skill in the art will recognized the importance of such factors as the termination bypass capacitor and the size and location of the through-hole vias in the design of the termination resistor. These factors exhibit unwanted, parasitic inductance which must be accounted for in the design of circuit (or network) connecting the termination resistor. Accordingly, it may be advantageous to provide an electrical connector having a fully integrated termination resistor following the last slot of the connector. This is particularly true where motherboard manufacturers lack a significant amount of experience in the design of high frequency systems and circuits.

The terms "first" and "last" are used to describe connector slots in relation to one another. A first connector slot is typically the closest slot to the controller and the farthest slot from the termination resistor. However, this designation assumes a contemporary bus system description in which command signals originate in a controller, traverse the length of the bus, and end at the termination resistor. With this assumption, the first slot is typically first populated with a module in order to provide a "base" (i.e., a minimal system) having the shortest signal propagation time. Thereafter, slots in the electrical connector are normally populated with modules in order from first to last.

Naturally, these relative descriptions, while are calculated to best describe the invention as taught by the present examples, are not to be interpreted in a wooden or literal sense. A "first" connector slot might equally be read to mean the first slot populated by the bus system integrator, regardless of the motivation for selecting that particular slot.

FIG. 6 further illustrates the use of a vertical connector in another aspect of the present invention. In FIG. 6, vertical connector 60 is mounted on motherboard 10. Connector 60 includes a plurality of module slots (60*a*, 60*b*, 60*c*. . . 60*n*). In contrast to the vertical termination connector shown in FIG. 5 which incorporated a fixed termination resistor 50 after the last slot of the connector, the vertical connector shown in FIG. 6 relies on a termination module 64 to implement a (positionally) variable termination resistor. Termination module 64 is normally placed in the first unoccupied slot of the electrical connector slots, i.e., the first slot not occupied by a module.

The embodiment shown in FIG. 6 provides a shorter overall bus length in relation to the number of modules actually used in the system. For example, when first installed the bus system shown in FIG. 6 included only first module 61 inserted in slot 60*a* and termination module 64 inserted in slot 60*b*. Subsequently, modules 62 and 63 were added to the bus system. As each new module is added to the system, the termination module 64 is moved to the next unoccupied slot in the electrical connector. This approach allows for the variable configuration of the bus system, but does so at the price of an electrical connector slot which must be used to connect termination module 64.

Figure 7:
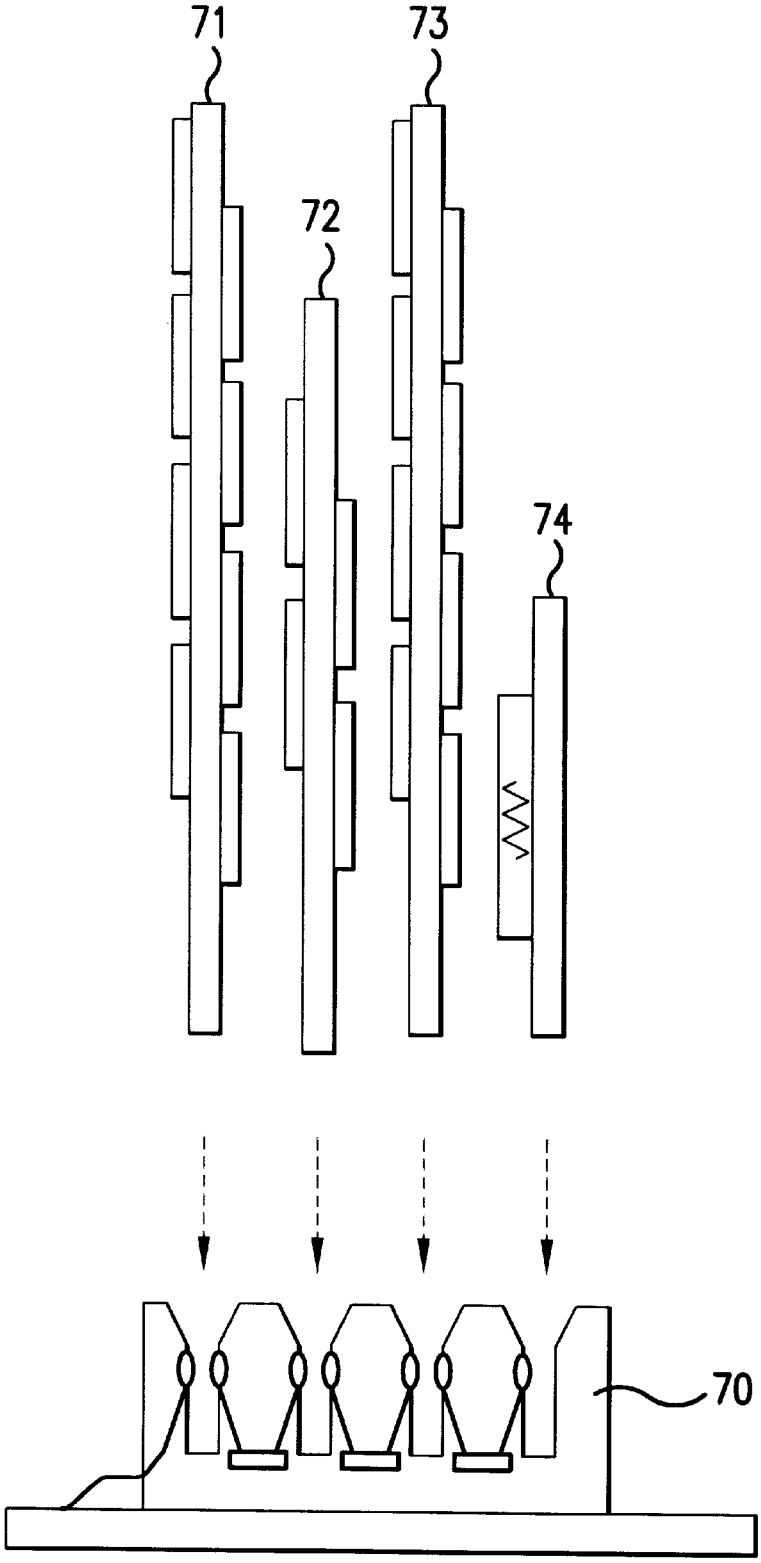
FIG. 7 illustrates another exemplary bus system configured in accordance with the present invention.

FIG. 7 illustrates a horizontal connector 70 receiving one or more modules (71, 72, 73) and termination module 74. There need not be any structural difference between the vertical and horizontal connectors of FIGS. 6 and 7 respectively, other than their orientation to the motherboard as defined by the bus system integrator. The vertical connector 60 of FIG. 6 allows a plurality of modules to be stacked one above the other. In contrast, the horizontal connector 70 of FIG. 7 allows a plurality of module to be vertically racked one next to the other.

Figure 8:
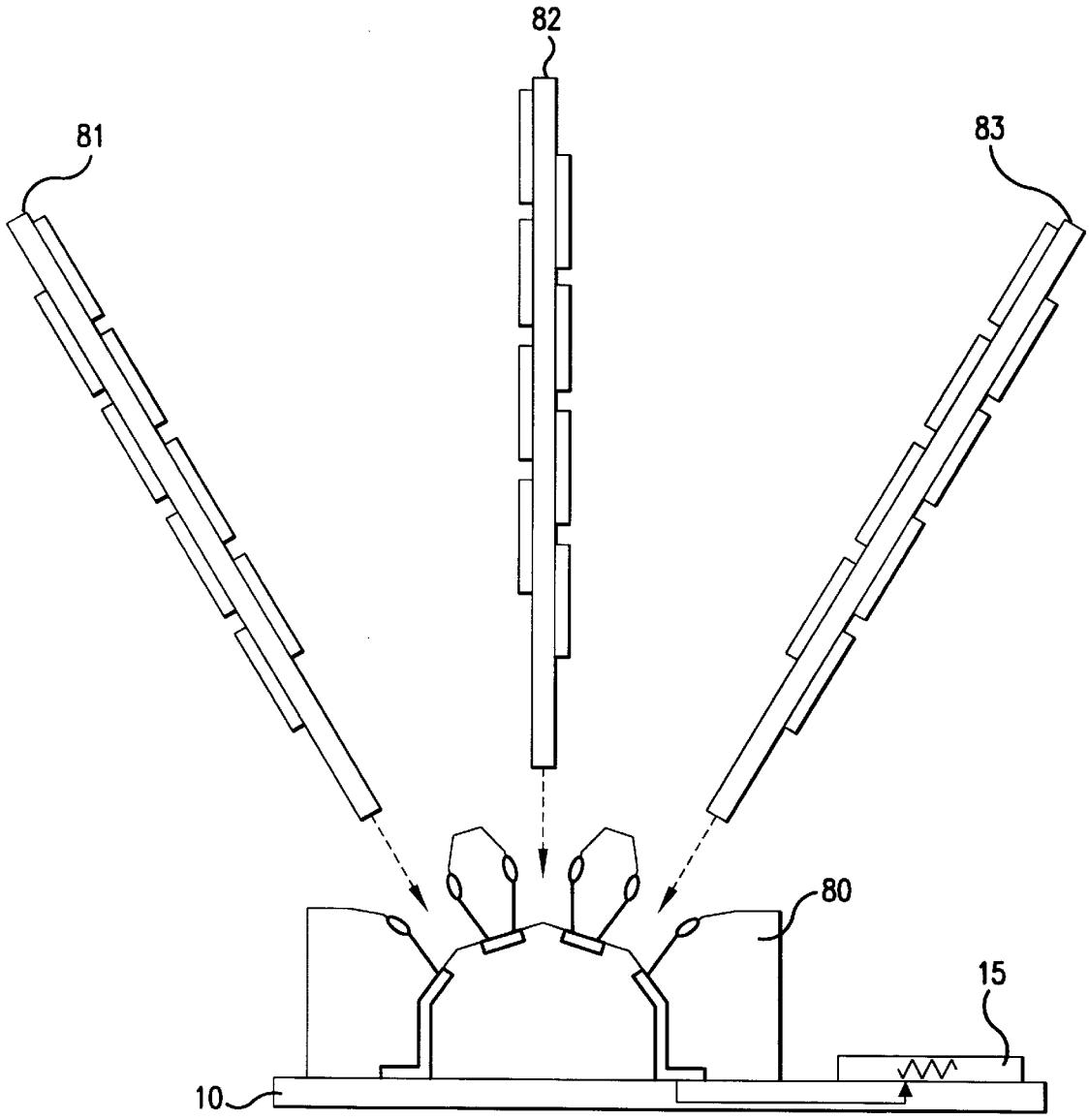
FIG. 8 illustrates yet another exemplary bus system configured in accordance with the present invention.

FIG. 8 illustrates another embodiment of the present invention in which the slots of an arcuit shaped connector 80 define a radial pattern of modules (81, 82, 83). The radial pattern of modules may provide beneficial thermal regulation capabilities and/or electrical signal isolation properties not realized by the vertical and horizontal patterns described above.

Figure 9A:
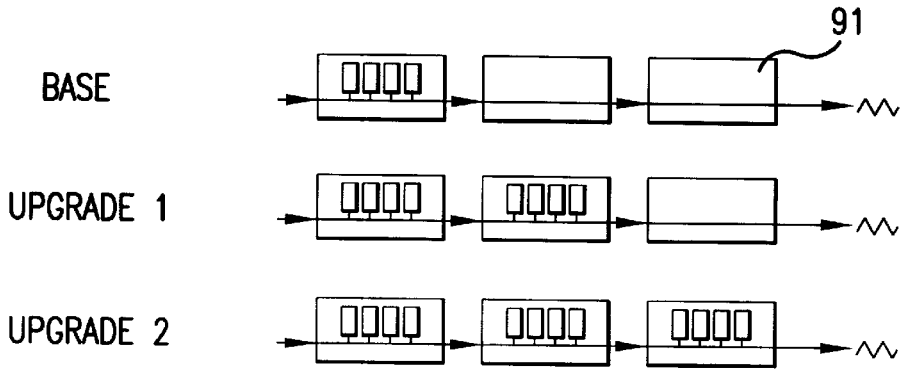
FIGS. 9A, 9B, and 9C illustrate exemplary termination options for bus systems configured in accordance with the present invention.
Figure 9B:
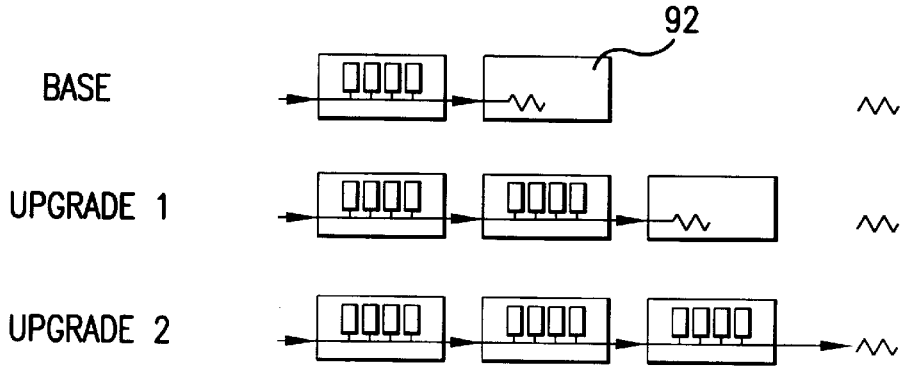
Figure 9C:
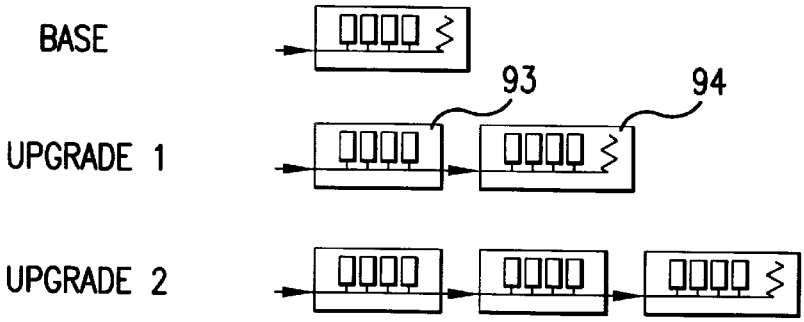

Several possibilities for connecting the termination resistor are summarized in the illustrations of FIGS. 9A, 9b and 9C. In the bus system contemplated in FIG. 9A, the electrical connector comprises a fixed termination resistor connected after the last slot. (See, e.g, the connector shown in FIG. 5). This type of electrical connector increases the number of slots made available for module connections when compared to the connector shown in FIG. 6. However, the electrical connector of FIG. 9A requires the use of one or more connection (or dummy) modules 91 for slots not having a module, since bus continuity must be provided from the first slot of the electrical connector to the termination resistor, regardless of the number of modules actually populating the connector.

The electrical connector shown in FIG. 9B is a hybrid of the connector shown in FIG. 5 and the bus system implementation contemplated in FIG. 6. Here, a fixed termination resistor is provided after the last slot, but a termination module 92 may be used to "shorten" the bus length where fewer than the maximum number of modules are inserted in the electrical connector.

Another bus system configuration is illustrated in FIG. 9C. This embodiment contemplates the use of two types of modules: one with a integral termination resistor 94 and one without 93. "Normal" modules lacking an integral termination resistor may be used, except for the last module inserted into the a slot of the electrical connector. This last module incorporates a termination resistor.

Alternatively, a single module type may be used which incorporates an electronically moveable (or actuated) termination resistor. Commonly assigned U.S. patent application No. 09/387,842 filed Sep. 1, 1999 discloses a module having an electronically moveable (or actuated) termination resistor. The subject matter of this document is incorporated herein by reference.

By use of modules having an electronically moveable (or actuated) termination resistor, the electrical connector of the present invention may be populated with a single type of module capable of holding a variable number of ICs. Further, special dummy modules and/or termination modules need not be provided since each module contains the ability to electronically implement a termination resistor, if required.

The foregoing embodiment have been given by way of example. Each describes one or more advantageous aspect of the present invention. Each illustrative embodiment provides an electrical connector having an integrated signal path between at least the inserted modules. As such, the impedance discontinuities characteristic of bus systems using conventional electrical connectors are eliminated. The present invention is not limited to the teaching examples, but is defined by the attached claims.

What is claimed is:

1. A connector having an integrated bus, adapted to be mounted on a motherboard, and adapted to receive one of more modules, the connector comprising:

a housing formed with a plurality of slots comprising at least a first slot and an Nth slot, each slot having lateral walls adapted to receive a module;

a plurality of electrical contacts formed substantially within the housing and between adjacent slots, each electrical contact comprising at least one first metal contact surface extending through the housing into one of the adjacent slots and at least one second metal contact surface extending through the housing into the other of the adjacent slots, such that the plurality of electrical contacts form a portion of the integrated bus between the adjacent slots;

wherein the plurality of electrical contacts comprises a first plurality of electrical signal contacts forming the integrated bus between the adjacent slots in conjunction with the one or more modules received in the connector, and a second plurality of electrical ground contacts selectively disposed between adjacent ones of the first plurality of electrical signal contacts; and, wherein the plurality of electrical contacts further comprises a first electrical contact connected to a high speed bus on the motherboard and having a metal contact surface extending through a wall of the first slot, and a last electrical contact connected to a termination resistor on the motherboard and having a metal contact surface extending through a wall of the Nth slot.

2. The connector of claim 1, further comprising:

an integrated ground plane connected to the second plurality of electrical ground contacts.

3. A bus system, comprising:

a motherboard having a high speed bus;

a connector mounted on the motherboard and connected at one end to the high speed bus, and comprising:

the connector comprising a housing formed with a plurality of slots, the plurality of slots being arranged from a first slot to a last slot, and a plurality of electrical contacts disposed substantially within the housing and forming a plurality of bus portions integral to the connector between adjacent ones of the plurality of slots; and a plurality of modules arranged from a first module to a last module, each one of the plurality of modules being inserted into one of the plurality of slots, such that the combination of the inserted plurality of modules and the plurality of bus portions forms a bus traversing the length of the connector from first slot to last slot.

4. The bus system of claim 3, wherein the last module comprises a termination module.

5. The bus system of claim 3, wherein the connector is vertically mounted on the motherboard, such that the plurality of modules are stacked one over the other when inserted in the connector.

6. The bus system of claim 5, wherein the connector further comprises:

an integral ground plane connected to ground on the motherboard: and, a termination resistor connected between the integral ground plane and the last slot.

7. The bus system of claim 6, wherein the plurality of modules comprises one or more dummy modules.

8. The bus system of claim 3, wherein the connector is horizontally mounted on the motherboard, such that the plurality of modules are racked one next to the other when inserted in the connector.

9. The bus system of claim 8, wherein the motherboard further comprises a termination resistor, and the bus system further comprises:

a first electrical connection between the high speed bus and a first electrical contact associated with the first slot;

a second electrical connection between the termination resistor and a last electrical contact associated with the last slot.

10. The bus system of claim 8, wherein the plurality of modules comprises a termination module.

11. The bus system of claim 3, wherein the connector is arcuit shaped, such that the plurality of modules are radially arranged when inserted in the connector.

12. The bus system of claim 11, wherein the motherboard further comprises a termination resistor, and the bus system further comprises:

a first electrical connection between the high speed bus and a first electrical contact associated with the first slot;

a second electrical connection between the termination resistor and a last electrical contact associated with the last slot.

13. The bus system of claim 11, wherein the plurality of modules comprises a termination module.

14. The bus system of claim 3, wherein the plurality of modules comprises a module having an integrated termination resistor.

15. The bus system of claim 3, wherein the plurality of modules comprises a module having an electrically actuated termination resistor.

* * * * *